United States Patent [19]

Baumann

[11] 4,155,301

[45] May 22, 1979

[54] FLY PRESS

[75] Inventor: Willi Baumann, Oetisheim, Fed. Rep. of Germany

[73] Assignee: Hiller & Lutz, Oetisheim, Fed. Rep. of Germany

[21] Appl. No.: 877,107

[22] Filed: Feb. 13, 1978

[30] Foreign Application Priority Data

Feb. 26, 1977 [DE] Fed. Rep. of Germany ..... 2708534

[51] Int. Cl.[2] ..... B30B 1/18

[52] U.S. Cl. ..... 100/270; 100/289

[58] Field of Search ..... 100/270, 271, 289; 72/454; 83/631

[56] References Cited

U.S. PATENT DOCUMENTS 3,507,143 4/1970 Georg ..... 100/270 X 3,512,476 5/1970 Georg ..... 100/270

3,595,163 7/1971 Baumann ..... 100/270

*Primary Examiner*—Billy J. Wilhite

[57] ABSTRACT

A fly press has a frame and a press screw rotatably mounted in said frame, and a flywheel attached for rotation with the press screw at one end, and a hydraulically driven ram rotatably attached to the other end of the press screw. An upper thrust bearing appears at one side of the frame for engagement by the flywheel, and a lower thrust bearing appears at the other side of the frame for engagement by a collar carried by the press screw. The upper and lower thrust bearings are spring biased in opposite directions. The abutment for the upper press bearing is engaged without impact when the collar disengages from the lower thrust bearing after the press blow to reduce the destructive effects on the bearing by press blows and return of the ram.

18 Claims, 1 Drawing Figure

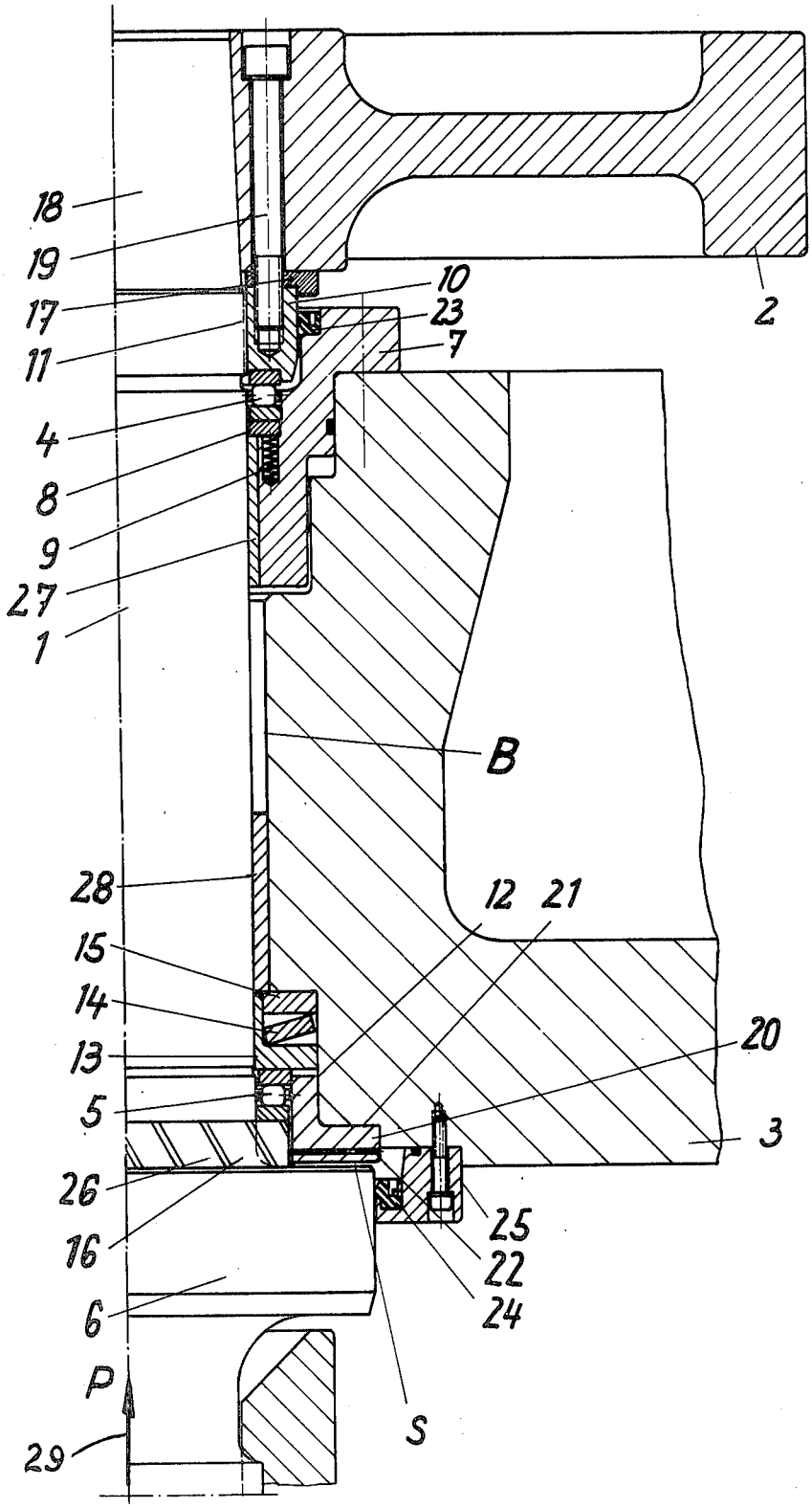
18
19
17
11
4
8
9
27
1
10
23
7
2
B
28
12
21
15
14
13
5
20
3
26
16
25
22
24
6
P
29
S

FLY PRESS

This invention relates to a fly press in which a press ram is driven by piston-cylinder means and constitutes a nut, which surrounds a press screw and has coarse screw threads in engagement with corresponding screw threads of the press screw, which is mounted in a cross head of the press frame.

In known fly presses, a flywheel is mounted in the press frame, the press ram is vertically reciprocated by double-acting piston-cylinder means, and the energy stored in the flywheel is utilized for the press blow in that it is transmitted from the flywheel by the press screw and the coarse screw threads to the ram when the movement of the latter is reversed.

In these fly presses in which the flywheel and the press screw are mounted in the press frame, the axial bearings in the cross head of the frame are highly loaded during the press blow. That load increases with the size and the cycle frequency of the press and may result in the destruction of the bearings. Besides, the ram is in high-friction contact with a shoulder stop as the press ram is returned by the piston-cylinder means and this friction should be reduced so that the ram can return freely.

It is a main object of the invention to relieve the bearings of the frame from loads which are due to the press blow and from the frictional contact at the stop for the ram during the return thereof.

In a fly press in which a press ram driven by piston-cylinder means constitutes a nut which is connected by coarse screw threads to a press screw, which carries a flywheel and is mounted in a cross head of a press frame, and in which said cross head is provided on one side with an upper thrust bearing for engagement by the flywheel and on the other side with a lower thrust bearing for engagement by a collar carried by the press screw, that object is accomplished in that the upper and lower thrust bearings are spring-biased in mutually opposite directions and a compensating ring is arranged to engage the abutment for the upper thrust bearing without impact when the collar disengages from the lower thrust bearing after the press blow. This arrangement will prevent a destruction of the bearings by the press blows and by the return of the ram.

The compensating ring associated with the upper thrust bearing may rest on compensating springs, which are disposed in the bearing sleeve, and the upper thrust bearing may be engageable by stop ring, which is screw-threaded on mating screw threads of the press screw.

According to a further feature of the invention a flanged bushing for retaining a washer and a disc spring is disposed in recess of the cross head and that recess contains also the lower thrust bearing, which is preferably provided on its other side with the collar carried by the press screw. As a result of this arrangement, the bearings are biased towards each other so that the formation of a bearing clearance, which would accelerate the wear of the bearing, is prevented during the press blow and return stroke of the press.

Further details of an illustrative embodiment of a fly press driven by piston-cylinder units, in accordance of the invention, will be described hereinafter with reference to the drawing, which is a partly sectional view showing how a press screw carrying a flywheel is mounted in a cross head of a press frame by means of two thrust bearings.

Certain features of the embodiment which will be described more fully hereinafter are apparent from U.S. Pat. No. 3,595,163, the disclosure of which is explicitly referred to and considered part of the present application. In that known fly press, the press screw carries two oppositely handed screw threads, which are in threaded engagement with a nut carried by the traverse of the press frame, particularly a nut which is rigid with said traverse and with the press ram so that the latter moves up and down at twice the speed of the screw. This arrangement enables a given number of press cycles to be performed per unit of time with a lower input power than was required before.

The piston-cylinder units which at one end thereof engage the traverse and preferably extend through the same may engage at their other end a screw-mounting bridge member disposed between the oppositely handed screw threads. Alternatively, the piston-cylinder units bear at one end on the traverse of the press and at the other hand on a screw-mounting bridge disposed over the flywheel. In both cases, the piston-cylinder units move only at one-half of the speed of the vertically reciprocating ram of the press. Because the stroke of the piston is only one-half of the stroke of the ram, lower oil flow rates are sufficient so that the space requirement and structural expenditure are reduced and an overheating of the control valves is avoided.

The press ram 29 of the fly press which is shown is driven by piston-cylinder means and constitutes a nut, which has coarse screw threads, which engage mating screw threads of a press screw 1, which is mounted in a cross head 3 of the press frame and carries a flywheel 2. This arrangement is known per se. It is apparent from the drawing that an upper thrust bearing 4 provided on the cross head 3 is engageable by the flywheel 2 and a lower thrust bearing 5 is engageable by a collar 6 carried by the press screw when the latter rotates during the return stroke of the ram. The upper thrust bearing 4 for supporting the flywheel 2 is supported in a bearing sleeve 7 on a compensating ring 8, which is disposed in a recess of the sleeve 7 and which rests on compensating springs 9 also disposed in said recess. The press screw 1 has a portion 11 in screw-threaded engagement with a stop ring 10, which is engageable with the top of the bearing 4. The cross head 3 has on its underside a recess 12, which contains a washer 15, a flanged bushing 13, and a disc spring 14 between the washer 15 and the underlying flange of the flanged bushing 15. The recess 12 contains also the lower thrust bearing 5, which bears at its top on the flanged bushing 13 and is provided at its bottom with a pressed-on backing ring 16, which rests on the collar 6 carried by the press screw so that the bearings are urged toward each other. A stop ring 10 associated with the upper thrust bearing 4 is screw-threaded on a portion 11 of the press screw and is enclosed by a centering ring 17, which supports the flywheel 2, which is fitted on the tapered end portion 18 of the press screw 1. Screws 19 are fitted in the flywheel and extend through the centering ring 17 and are screw-threaded in peripherally spaced apart, tapped bores formed in the stop ring 10 to hold down the flywheel 2 and the centering ring 17 on the stop ring 10.

The backing ring 16 associated with the lower thrust bearing 5 is surrounded by a stop ring 20, which is disposed in an annular recess 21 formed in the cross head 3 around the recess 12. The stop ring 20 is formed with angularly spaced apart oil bores 22, which extend radially through the stop ring 20 and are open at opposite ends, and is spaced by a clearance S above the collar 6 carried by the press screw. The stop ring 20 serves to take up the force (arrow P), which is due to the main blow of the press.

An oil bath B is held between the stop ring 10 and a sealing ring 23 fitted on the stop ring 10 and in the upper bearing sleeve 7, and the collar 6 carried by the press screw and a sealing ring 24 fitted on said collar and in a carrying ring 25. The oil is forced up through helical grooves 26 on the backing ring 16 into the clearance space defined by the stop ring 20 during the upward movement of the press ram 29 and can escape through bores 22 without a pressure peak during the force (arrow P) which is due to the press blow. In conjunction with the other features which have been described, the arrangement of all axial and radial bearings for the press screw 1 in an oil bath B in the cross head 3 results in a substantial decrease of the load on the bearings during the press blows and of the stop for the ram 29 during the upstroke.

During the downstroke of the ram 29, the weight of the moving masses results in rolling friction in the thrust bearings 4 and 5, which consist of axial roller bearings. The entire press screw 1 runs in an oil bath. During the press blow, the oil volume disposed in the clearance space S defined by the stop ring 20 is displaced toward the press screw and the collar 6 then bears on the stop ring 20, which is made from a bronze alloy hardened steel. The thrust bearings 4 and 5 are thus relieved. The upper bearing sleeve 7 is lined by a sliding surface bearing bushing 27. The shaft of the press screw 1 is surrounded by a sliding surface bearing bushing 28 above the lower supporting bearing 5.

During its return stroke, the ram 29 is pushed against the press screw so that the collar 6 is forced against the stop ring 20 and thus tends to displace the oil film. This could block the rotational movement if such blockage were not prevented by the provision of the flanged bushing 13, which is associated with the lower thrust bearing 5 and biased by an oppositely acting spring 14. In this way, rolling friction in the lower thrust bearing is eliminated during the press blow so that damage to the bearing is prevented.

What is claimed is:

1. A fly press which comprises a frame, a press screw rotatably mounted in said frame, a flywheel mounted on said press screw for rotation therewith and disposed on a first side of said frame, a press ram, which is disposed on a second side of said frame opposite to said flywheel and is axially movable relative to said frame in a first direction for a pressing stroke and in a second direction during a press blow and for a return stroke, said press ram being operatively connected to said press screw to rotate the latter relative to said frame during an axial movement of said press ram relative to said frame, a collar carried by said press screw and disposed on said second side of said frame and adapted to define an axial clearance space with said frame and to engage said frame during said press blow, a first thrust bearing axially slidably mounted in said frame and engaging said press screw in said second direction, a first abutment limiting the movement of said first thrust bearing relative to said frame in said first direction, first spring means biasing said first bearing in said second direction, a second thrust bearing axially slidably mounted in said frame and engaging said press screw in said first direction, a second abutment limiting the movement of said second thrust bearing relative to said frame in said second direction, and second spring means biasing said second bearing in said first direction.

2. A fly press as set forth in claim 1, which comprises piston-cylinder means for moving said press ram in said first and second directions.

3. A fly press as set forth in claim 1, in which said ram constitutes a nut, which is connected to said press screw by coarse screw threads.

4. A fly press as set forth in claim 1, in which said first bearing is in engagement with said flywheel and said second bearing is in engagement with said collar.

5. A fly press as set forth in claim 1, in which a compensating ring is disposed between said first bearing and said first abutment and engageable with the latter to limit the movement of said first bearing relative to said frame in said first direction and said compensating ring is biased by said first spring means in said second direction.

6. A fly press as set forth in claim 1, in which a bearing sleeve is mounted in said frame and surrounds said press screw and is formed with a plurality of peripherally spaced apart, axial bores which are open in said second direction and contain said first spring means.

7. A fly press as set forth in claim 1, in which said press screw has a screw-threaded portion, a stop ring is in screw-threaded engagement with said screw-threaded portion, and said first bearing engages said stop ring in said second direction.

8. A fly press as set forth in claim 7, in which a centering ring encloses said stop ring, said press screw has a tapered end portion on said first side of said frame, and said flywheel is fitted on said tapering end portion and engages said centering ring in said first direction.

9. A fly press as set forth in claim 8, in which screw means are fitted in said flywheel and screw-threaded into said stop ring with said centering ring interposed to connect said flywheel to said stop ring.

10. A fly press as set forth in claim 1, in which said frame is formed on said second side with a recess, which is defined by said second abutment, said second bearing extends in said recess and said second spring means comprises a disc spring disposed between said second abutment and said second bearing

11. A fly press as set forth in claim 10, in which a washer is disposed between said second spring means and said second abutment and a flanged bushing is disposed in said recess and has a tubular portion, which is radially disposed between said press screw, on the one hand, and said spring washer and said second spring means, on the other hand, and a radial flange disposed between said second spring means and said second bearing.

12. A fly press as set forth in claim 10, in which a backing ring surrounds said press screw between said second bearing and said collar and is rigid with said second bearing and in engagement with said collar.

13. A fly press as set forth in claim 12, in which said recess has a radially outwardly enlarged portion at its axially outer end, a stop ring extends in said enlarged portion and surrounds said backing ring, and said collar faces said stop ring in said second direction and is adapted to define an axial clearance space with said stop ring during a movement of said ram in said first direction and to engage said stop ring during said press blow.

14. A fly press as set forth in claim 13, in which said second spring means are arranged to cushion said second bearing when said collar engages said stop ring.

15. A fly press as set forth in claim 13, in which said first bearing is axially slidably mounted in a bearing sleeve mounted in said frame and surrounding said press screw on said first side of said frame, a first sealing ring is disposed in said bearing sleeve and in sealing radial engagement with said bearing sleeve and said press screw axially outwardly of said first bearing, a carrying ring is secured to and axially protrudes from said frame on said second side thereof and surrounds said collar, a second sealing ring is disposed in said carrying ring and in sealing radial engagement with said carrying ring and said collar axially outwardly of said second bearing, said press screw defines an annular oil clearance space with said frame, said bearing sleeve and said carrying ring, said oil clearance space is adapted to be filled with oil;

said backing ring is formed on its outside peripheral surface with helical grooves through which said oil clearance space is arranged to communicate with said clearance space between said collar and said stop ring, and said stop ring is formed with radial through bores, which open into said oil clearance space at opposite ends.

16. A fly press as set forth in claim 1, in which said first bearing is axially slidably mounted in a bearing sleeve mounted in said frame and surrounding said press screw on said first side of said frame, a first sealing ring is disposed in said bearing sleeve and in sealing radial engagement with said bearing sleeve and said press screw axially outwardly of said first bearing, a carrying ring is secured to and axially protrudes from said frame on said second side thereof and surrounds said collar, a second sealing ring is disposed in said carrying ring and in sealing radial engagement with said carrying ring and said collar axially outwardly of said second bearing, said press screw defines an annular oil clearance space with said frame, said bearing sleeve and said carrying ring and said oil clearance space is adapted to be filled with oil.

17. A fly press which comprises a frame, a press screw rotatably mounted in said frame, a flywheel mounted on said press screw for rotation therewith and disposed on a first side of said frame, a press ram, which is disposed on a second side of said frame opposite to said flywheel and is axially movable relative to said frame in a first direction for a pressing stroke and in a second direction during a press blow and for a return stroke, said press ram being operatively connected to said press screw to rotate the latter relative to said frame during an axial movement of said press ram relative to said frame, a collar carried by said press screw and disposed on said second side of said frame and adapted to define an axial clearance space with said frame and to engage said frame during said press blow, a first thrust bearing mounted in said frame and engaging said press screw in said second direction, a second thrust bearing mounted in said frame and engaging said press screw in said second direction, a bearing sleeve mounted in said frame and surrounding said press screw on said first side of said frame and containing said first bearing, a first sealing ring disposed in said bearing sleeve and in sealing radial engagement with said bearing sleeve and said press screw axially outwardly of said first bearing, a carrying ring which is secured to and axially protrudes from said frame on said second side thereof and surrounds said collar, and a second sealing ring disposed in said carrying ring and in sealing radial engagement with said carrying ring and said collar axially outwardly of said second bearing, said press screw defining an annular oil clearance space with said frame, said bearing sleeve and said carrying ring, said oil clearance space being adapted to be filled with oil.

18. A fly press as set forth in claim 17, in which said frame is formed on said second side with a recess, which has a radially outwardly enlarged portion at its axially outer end, said second bearing extends in said recess, a backing ring surrounds said press screw between said second bearing and said collar and is rigid with said second bearing and in engagement with said collar, a stop ring extends in said outwardly enlarged portion and surrounds said backing ring, said collar facing said stop ring in said second direction and being adapted to define an axial clearance space with said stop ring during a movement of said ram in said first direction and to engage said stop ring during said press blow, said backing ring being formed on its outside peripheral surface with helical grooves through which said oil clearance space is arranged to communicate with said clearance space between said collar and said top ring, said stop ring being formed with radial through bores, which open into said oil clearance space at opposite ends.

* * * * *